US007504023B2

(12) United States Patent
Chamberlain Pravia et al.

(10) Patent No.: US 7,504,023 B2
(45) Date of Patent: Mar. 17, 2009

(54) PROCESS FOR REDUCING THE NAPHTHENIC ACIDITY OF PETROLEUM OILS

(75) Inventors: Oscar René Chamberlain Pravia, Rio de Janeiro (BR); Henrique Soares Cerqueira, Rio de Janeiro (BR); Elizabeth M. Moreira, Rio de Janeiro (BR); Cláudia Maria de L. Alvarenga Baptista, Rio de Janeiro (BR); Jefferson Roberto Gomes, Rio de Janeiro (BR); Paulo César Peixoto Bugueta, Rio de Janeiro (BR)

(73) Assignee: Petroleo Brasileiro S.A., Rio de Janeiro (BR)

( * ) Notice: Subject to any disclaimer, the term of this patent is extended or adjusted under 35 U.S.C. 154(b) by 0 days.

(21) Appl. No.: 11/513,013

(22) Filed: Aug. 31, 2006

(65) Prior Publication Data

US 2006/0283781 A1 Dec. 21, 2006

Related U.S. Application Data

(63) Continuation of application No. 10/611,105, filed on Jul. 2, 2003, now abandoned.

(30) Foreign Application Priority Data

Jul. 5, 2002 (BR) ..... 0202552

(51) Int. Cl.
*C10G 25/00* (2006.01)
*C10G 25/12* (2006.01)

(52) U.S. Cl. ..... 208/263; 208/299

(58) Field of Classification Search ..... 208/263, 208/299

See application file for complete search history.

(56) References Cited

U.S. PATENT DOCUMENTS 1,561,999 A * 11/1925 Prutzman ..... 208/300
2,789,081 A 4/1957 Mills
2,931,771 A * 4/1960 Holm ..... 208/263
2,943,040 A * 6/1960 Weisz ..... 208/91
3,034,980 A 5/1962 Honeycutt
3,133,960 A * 5/1964 Ewing, Jr. et al. ..... 562/511
3,176,041 A * 3/1965 Ayers et al. ..... 562/511
3,222,275 A 12/1965 Krewer
3,445,380 A * 5/1969 Urban ..... 208/206
3,457,165 A * 7/1969 Urban ..... 208/263
4,070,271 A * 1/1978 Carlson et al. ..... 208/206
4,137,151 A 1/1979 Csicery
4,199,440 A 4/1980 Verachtert
4,300,994 A 11/1981 Liotta
4,647,366 A 3/1987 Edmondson
4,824,818 A * 4/1989 Bricker et al. ..... 502/163
4,946,596 A * 8/1990 Furuta et al. ..... 210/679
5,039,398 A * 8/1991 Stine et al. ..... 208/192
5,182,013 A 1/1993 Petersen
5,324,417 A * 6/1994 Harandi ..... 208/113
5,389,240 A * 2/1995 Gillespie et al. ..... 208/226
5,914,030 A 6/1999 Bearden et al.
5,919,354 A * 7/1999 Bartek ..... 208/299
5,961,821 A 10/1999 Varadaraj
5,985,137 A 11/1999 Ohsol
6,054,042 A 4/2000 Gorbaty
6,086,751 A 7/2000 Bienstock
6,190,541 B1 2/2001 Siskin
6,258,258 B1 7/2001 Sartori
6,281,328 B1 8/2001 Sartori
6,454,936 B1 * 9/2002 Varadaraj ..... 208/263
6,531,055 B1 3/2003 Greaney

FOREIGN PATENT DOCUMENTS

WO WO 01/79386 10/2001

* cited by examiner

*Primary Examiner*—Glenn Caldarola
*Assistant Examiner*—Randy Boyer
(74) *Attorney, Agent, or Firm*—Nixon & Vanderhye P.C.

(57) ABSTRACT

A process for reducing the naphthenic acidity of petroleum oils, or their liquid fractions, is described, the process comprising a thermal treatment of the petroleum oils, or their liquid fractions, in the presence of an adsorbent the surface of which is covered by high molecular weight carbon compounds. Preferred adsorbents are the spent or coked FCC catalysts.

11 Claims, No Drawings

PROCESS FOR REDUCING THE NAPHTHENIC ACIDITY OF PETROLEUM OILS

This application is a continuation of U.S. application Ser. No. 10/611,105, filed Jul. 2, 2003, now abandoned the entire content of which is incorporated by reference in this application.

FIELD OF THE INVENTION

The present invention relates to a process for reducing the naphthenic acidity of petroleum oils, or of their liquid fractions, by thermal treatment, in the presence of an adsorbent.

More particularly, the invention relates to a process which promotes the conversion of naphthenic acids present in petroleum oils, or in their liquid fractions, to CO, $CO_2$ and $H_2O$, by means of catalytic conversion, in order to make these products less harmful to the equipment which are designed to process it.

Further the invention reduces the viscosity of petroleum oils by decomposing the carboxylic moieties of the naphthenic acids and thus minimizes the possible occurrence of one of the factors which leading to increased petroleum oil viscosity as a consequence of the interaction among its own carboxylic moieties.

BACKGROUND OF THE INVENTION

In view of the fact that recently discovered petroleum oils are increasingly heavy and of high naphthenic acidity, besides being very viscous has created a challenge to be met by the petroleum industry. Petroleum oils having high content in organic acids are strongly corrosive to the equipment used in the extraction, transportation and processing of oil and consequently, any reduction in naphthenic acidity would alleviate corrosion-associated problems.

Those kinds of petroleum oils and their respective liquid fractions having high contents of organic acids are particularly detrimental to the refineries process equipment, especially when those raw materials are used in distillation towers, where high corrosion levels and incrustations have been observed. In Brazil, petroleum oils from the Campos Basin, like Marlin, Albacora e Siri have shown such characteristics and their organic acids are normally naphthenic acids.

U.S. Pat. No. 6,054,042 teaches that naphthenic acidity can be expressed as Total Acid Number (TAN) which means quantity of milligrams of KOH required to neutralize one gram of oil. The analytical method used for the measurements is the D-664 ASTM Method.

Determinations made by infrared spectroscopic analysis allow to estimating the naphthenic acidity contents by measuring the area under the carboxyl characteristic band between 1700 and 1750 $cm^{-1}$. By combining results from both methods, it is possible to obtain an approximate measure of how much acidity is due to carboxylic acids.

Several approaches to reduce naphthenic acidity in petroleum oils have been adopted in the art.

In order to minimize the problem, one of those is directed to the use of a mix of petroleum oils of different acidity levels.

Another one uses corrosion inhibitor additives to control the acidity. U.S. patents U.S. Pat. No. 5,182,013 and U.S. Pat. No. 4,647,366 teach different types of these inhibitors.

Acidity reduction can yet be obtained by treating oil with basic solutions of NaOH and KOH, as taught in U.S. patent U.S. Pat. No. 4,199,440. However, this method demands the use of strong basic solutions and shows a critical point, which is the formation of hard-to-break stable emulsions. In order to avoid such emulsification problems, an alkaline detergent treatment, based on calcium sulfonate or naphtenate addition is claimed in U.S. Pat. No. 6,054,042.

In U.S. Pat. No. 6,258,258 the use of anhydrous solutions of ammonia is described. In U.S. Pat. No. 6,281,328 polymeric amine solutions, as polyvinyl pyridine are indicated for the same use. U.S. Pat. No. 4,300,995 teaches an oil treatment with a basic solution of quaternary hydroxides, such as tetramethyl ammonium hydroxide, in alcohol or water.

WO 01/79386 teaches the use of a basic solution and metals from group IA, IIA and ammonia hydroxides together with a transfer agent, as the quaternary non-basic salts and polyethers.

U.S. Pat. No. 6,190,541 teaches the use of bases from hydroxides and phosphates with an alcohol.

According to U.S. Pat. No. 6,086,751, acidity may be reduced by thermal treatment. The oil is initially flashed to effect water removal and after that, the effluent is heated to temperatures between 340 and 420° C., pressures below 0.7 MPag and reaction times up to 2 hours.

According to U.S. Pat. No. 5,985,137, naphthenic acidity and sulfur contents of petroleum oils are reduced by reacting with alkaline earth metal oxides, which produce neutralized compounds and alkaline earth metal sulfides. Temperatures must be higher than (or: in excess of) 150° C. to remove carboxylic acids and higher than 200° C. to produce sulfide salts. The applied pressure should be high enough to keep the oil in the liquid state.

Generally, methodologies to reduce the naphthenic acidity make use of thermal treatments that proceed at temperatures around 400° C. and pressures about 1 MPag. However, such methodologies depend on alkaline solution additions to neutralize that acidity. In such cases, the necessity of additional use of surfactants, to control emulsification problems, render the operation more expensive and harder to process. Surfactants are highly expensive chemical products.

Therefore, in spite of the research effort directed to the problem of minimizing naphthenic acidity in petroleum oils, the technique still needs a process directed to reducing the level of naphthenic acids to acceptable grounds, such a process, based on a thermal treatment in the presence of coked (spent) Fluid Catalytic Cracking (FCC) catalysts being described and claimed in the present invention.

SUMMARY OF THE INVENTION

The present invention relates to a process for reducing the naphthenic acidity of petroleum oils, or of their liquid fractions, the oil having being desalted and dewatered, wherein the process comprises the following steps:

a) in a reactor, contacting the feedstock of naphthenic acidic petroleum oil, or its liquid fractions, with an adsorbent, at a ratio of adsorbent/petroleum oil (or its liquid fractions) in the range of 0.1 to 5, at temperatures between 200° C. and 500° C., under pressures from 0.01 to 0.3 MPag and residence time between 1 second and 2 hours, so as to effect the desired reduction in naphthenic acidity and obtain a treated feedstock;

b) on the treated feedstock obtained in a), separating, with the aid of a liquid/solid separation system, the used adsorbent from the petroleum oil, or from its liquid fractions, which had their naphthenic acidity reduced so as to produce a treated, separated feedstock;

c) directing the treated, separated feedstock from b) to further processing.

Therefore, one objective of the present invention is a process to promote the conversion of naphthenic acids present in petroleum oils, or in their liquid fractions, to CO, $CO_2$ and $H_2O$, by contacting said feedstock with FCC spent or coked catalysts.

Additionally, another objective of the present invention is a process that provides a viscosity reduction of the crude petroleum oils processed according to said process.

DETAILED DESCRIPTION OF THE INVENTION

Recent research developed by the Applicant has been directed to evaluating the effect of thermal treatment in petroleum oils and in their liquid fractions which have considerable values of naphthenic acidity, in the presence of an adsorbent covered with high molecular weight carbon compounds.

Among the adsorbents useful for the purposes of the invention is a coked catalyst used in Fluid Catalytic Cracking (FCC) processes, the adsorbent being covered by a superficial deposit of petroleum coke which has reduced its catalytic activity by 50 to 70% from the original one. Such deposit is formed by thermal and catalytic mechanisms and is made up by heteroatom-rich polycondensed aromatic molecules and asphaltene structures, which become adherent to the catalyst surface. These molecular structures, as well as the chemical nature of the petroleum coke, promote the interaction between hydroxyl group-bearing molecules of petroleum, with the consequence that at least, 80% of the naphthenic acids present in the feedstock are reduced, without no other additional chemical treatment, even though at the low temperatures and pressures used in the experiments.

Thus it is clear that the state-of-the-art technique can be improved if a process is provided which is able to maximize reduction in the naphthenic acidity of petroleum oil, or of its liquid fractions, dispensing with the use of alkaline solutions and thus avoiding additional use of chemical products.

The present invention reduces the naphthenic acidity of petroleum oils and of their liquid fractions by promoting the decomposition of those naphthenic acids to CO, $CO_2$ and $H_2O$ by means of a thermal treatment effected in the presence of FCC spent or coked catalysts, among other adsorbents, which eliminates the problems caused by the utilization of alkaline solutions and, additionally, allows the reduction of the refinery residue inventory.

Adsorbents suitable to promote the desired effect of naphthenic acidity conversion are those of large specific area and high content of surface carbon like, for example, carbon black, or FCC spent or coked catalyst, but not limited to them. Specific areas of the spent or coked catalyst of FCC, suitable to be used in the treatments described herein are in the range of from 60 to 250 $m^2/g$, but preferably of from 100 to 200 $m^2/g$. So, any carbonated material supposed to be able to promote a chemical or physical interaction similar to that pointed out in the present specification can be used for the purposes of the invention.

The use of the carbonated material, supported or not by a catalyst matrix, allows, based on Van der Waals forces, the action of the said carbonated material on petroleum, or on its liquid fractions, as an adsorbent surface which attracts and retains carboxylic acids present therein and thus naphthenic acidity is reduced.

In the case of the coked catalyst, the said adsorption phenomenon occurs by chemical interactions between carboxyl functional groups of the oil product and the heteroatoms present in considerable concentrations in the said coked catalyst.

The use of the spent FCC catalyst according to the invention dispenses with the need of any alkaline solutions to neutralize the naphthenic acids, eliminating the presence of an aqueous phase which brings some drawbacks by producing stable emulsions in the presence of oil, such emulsions being normally very hard to break down.

The catalytic conversion reactions of the carboxylic acids yield CO, $CO_2$ and water vapor; in such a way, it becomes necessary to provide ventilation or a purge system using inert vapors such as nitrogen, natural gas or light hydrocarbon vapors.

In practice, the present invention may require or not that the feedstock to be processed be submitted to a desalting process before being flashed to remove water and possible light fractions.

Usually, desalting is required in petroleum oils of salt contents higher than 2 Kg of salt per 160 thousand liters of petroleum. The desalting is a common process and well-known among those skilled in the refining art.

The flashing step is normally required because water is almost always present in oil and its content should be strongly reduced. Besides, in many cases, the extremely heavy petroleum oils have to be diluted with naphtha either in order to allow transportation, or to improve pumpability.

During the flashing step, gaseous streams of $C_4$ light fraction, water and any diluents are vaporized in the flashing condition which normally reaches temperatures of from 120° C. to 370° C. and pressures of from the atmospheric to 1.7 MPag. Flashing time is usually determined by the necessity of a substantial reduction in the water present in the petroleum which has to be decreased to levels as low as 0.5% by weight, preferably lower than 0.1 % by weight.

As for the desalting process, the flashing procedures are identically well-known to those skilled in the refining art.

The temperature, the pressure and the reaction time to be practiced in the present invention depend upon the nature of the petroleum oil to be treated, the naphthenic acidity level of that petroleum oil and space velocity used in the reactor.

Normally, the conversion reaction is done at temperatures between 200° C. and 500° C., but, preferably between 250° C. and 350° C., under pressures of from 0.01 to 0.3 MPag and residence time between 1 second and 2 hours.

The ratio of adsorbent/petroleum oil or its liquid fractions is in the range of 0.1 to 5, more preferably in the range 1 to 5.

The thermal treatment in the presence of the adsorbents mentioned herein makes possible to reduce the naphthenic acidity of petroleum oils, or of their liquid fractions, from TAN figures as high as 5.0 mg of KOH/g of oil to values lower than 0.5 mg of KOH/g, dispensing with the use of high pressures such as pressures over 1.0 MPag.

The liquid/solids separation systems useful to effect the separation of the adsorbents from the treated feedstock are those commonly described in the literature as, for example, the cyclones, or hydrocyclones, or centrifuges that are systems well known to those skilled in the refining art.

Further interpretations about the nature and mechanisms of the phenomena herein described do not modify the practical meaning of the novelty brought by the present invention which will be now illustrated by the following Examples which should not be considered as limiting it.

EXAMPLE 1

A sample of Albacora oil, having a TAN of 1.7 mg KOH/g was fed to a tubular reactor and submitted to a thermal treatment at temperatures of 250, 350, 400 e 450° C., in the presence of a matrix covered by high molecular weight carbon compounds (spent FCC catalyst of specific area of 155 $m^2/g$), during 1 hour and under pressure of 0.01 MPag. The test results are shown in Table 1 below.

TABLE

| Tests | Temperature ° C. | Adsorbent | Ratio of adsorbent/oil | Retention and decarboxylation, by IR (1), (%) | Total Number (TAN, mg KOH/g |
|---|---|---|---|---|---|
| 1 | 250 | Spent FCC cat. | 5 | 94 | 0.3 |
| 2 | 350 | Spent FCC cat. | 5 | 82 | 0.5 |
| 3 | 400 | Spent FCC cat. | 5 | 74 | 0.6 |
| 4 | 450 | Spent FCC cat. | 5 | 85 | 0.3 |
| 5 | 350 | Spent FCC cat. + $NH_4OH$ | 5 | 82 | 0.5 |
| 6 | 350 | Inert matrix | 5 | 22 | 1.5 |
| 7 | 350 | Spent FCC cat. | 0.1 | 78 | 1.4 |
| 8 | 350 | Spent FCC cat. | 1 | 77 | 1.0 |

Obs.: (1) infrared

Based on results of the retention and decarboxylation column of TABLE 1 above it is concluded that TAN reduction occurs because there was a retention and decarboxylation of the naphthenic acids, in the range of 74 to 94%, for all temperatures.

EXAMPLE 2

Another sample of the same petroleum of Example 1 was thermally treated in a tubular reactor, at a temperature of 350° C., for 1 hour, under a pressure of 0.01 MPag, in the presence of a spent FCC catalyst that had previously been submitted to a treatment with a solution of ammonium hydroxide (10% by weight) in such a way that a mass ratio of $NH_4OH$/mass of catalyst of 0.1 was obtained. After the treatment, the catalyst was dried at 120° C., for 16 hours. Number 5 test, in Table 1 above, shows, in the retention and decarboxylation for IR column, the result obtained in the effluent of this experiment. When that result is compared with the result of number 2 test, it can be observed that the catalyst treatment did not affect the efficiency of carboxyl removal.

EXAMPLE 3

Another sample of the same petroleum of Example 1 was thermally treated in a tubular reactor, at a temperature of 350° C., for 1 hour, under pressure of 0.01 MPag, in the presence of an inert matrix made up of silicon spheres of 70 micron average size of and without carbon on their surface. Test number 6, in TABLE 1 above, shows the TAN results obtained in the effluent of the experiment. When that result is compared with the result obtained in test 2, it can be concluded that the presence of the spent catalyst is paramount for a successful treatment.

Therefore, it is clear that the present invention promotes the optimized removal of carboxylic acids from petroleum oils relative to other state-of-the-art methods, since not only such removal is more selective as the treatment products are gases or vapors that can be more easily withdrawn from the reactor than the neutralization products generated in prior processes.

Besides that, state-of-the art thermal treatments are not able to make such selective conversion and are supposed to promote secondary oxidation or cracking reactions which generate undesirable by-products, such as olefins, which are detrimental to the quality of valuable streams, such as naphtha and diesel oil, resulting from further processing of oil.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for reducing a naphthenic acidity of a feedstock of petroleum oils or of their liquid fractions, the method comprising the steps of:

feeding the feedstock to a reactor;

contacting, in the reactor, the feedstock with an adsorbent to cause a reduction of the napthenic acidity of the feedstock, wherein the adsorbent comprises a spent or coked FCC catalyst having a surface area of 60 to 250 $m^2/g$, wherein a ratio of adsorbent to feedstock ranges from 0.1 to 5, wherein the reactor has a temperature between 200° C. and 500° C. and a pressure of 0.01 to 0.3 MPag, wherein the reactor has a residence time of between 1 second and 2 hours, wherein an effluent exiting the reactor comprises a treated feedstock with a reduced naphthenic acidity and the adsorbent, and wherein the reduction of the napthenic acidity of the feedstock occurs substantially by thermal treatment; and separating, in a liquid/solid separation system, the treated feedstock from the adsorbent.

2. The method of claim 1, wherein the reduction of the napthenic acidity of the feedstock does not occur as a result of either contacting the feedstock with an alkali aqueous solution or a reaction in the presence of hydrogen.

3. The method of claim 1, wherein the reactor has a temperature between 250° C. and 350° C.

4. The method of claim 1, wherein the feedstock has a water content of less than 0.1% by weight.

5. The method of claim 1, wherein the surface area of the adsorbent is from 100 to 200 $m^2/g$.

6. The method of claim 1 further comprising the steps of:

treating the adsorbent with an alkaline solution prior to the step of contacting the feedstock with the adsorbent, wherein the concentration of an alkaline base of the alkaline solution is in the range of from 5 to 15% by weight, and wherein a mass ratio of alkaline base to mass of the adsorbent is from 0.05 to 0.5; and drying the adsorbent through exposure to a temperature between 100 and 120° C. for 10 to 16 hours.

7. The method of claim 6, wherein the alkaline base comprises a metal hydroxide of group IA.

8. The method of claim 6, wherein the alkaline base comprises a metal hydroxide of group IIA.

9. The method of claim 6, wherein the alkaline base comprises ammonium hydroxide.

10. The method of claim 6, wherein the alkaline base is selected from the group consisting of a metal hydroxide of group IA, a metal hydroxide of group IIA, ammonium hydroxide, and a mixture thereof.

11. The method of claim 1, wherein the liquid/solid separation system is selected from the group consisting of a cyclone, a hydrocyclone, and a centrifuge.

* * * * *